US005994008A

United States Patent [19]

Ogawa et al.

[11] Patent Number: 5,994,008

[45] **Date of Patent: *Nov. 30, 1999**

[54] COMPOSITION FOR FORMING FLUORESCENT FILM FOR DISPLAY AND METHOD OF FORMING FLUORESCENT FILM FOR DISPLAY

[75] Inventors: Yukio Ogawa; Yoshihisa Yonezawa; Katsutoshi Kougo; Kazuyoshi Ishikawa; Shigeo Itoh, all of Mobara; Tetsuaki Tochizawa, Inba-mura; Yasuo Kuniyoshi, Inba-mura; Toru Shibuya, Inba-mura; Hideo Kikuchi, Inba-mura, all of Japan

[73] Assignee: Futaba Denshi Kogyo K.K., Mobara, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/840,452

[22] Filed: Apr. 18, 1997

[30] Foreign Application Priority Data

Apr. 18, 1996 [JP] Japan ..... 8-096967
Apr. 24, 1996 [JP] Japan ..... 8-102446

[51] Int. Cl.[6] ..... H01J 9/227

[52] U.S. Cl. ..... 430/28; 430/26; 430/270.1; 430/321; 427/68; 427/64; 525/59; 525/61; 445/52; 445/58

[58] Field of Search ..... 430/270.1, 287.1, 430/283.1, 321, 320, 23, 26, 28; 525/59, 61; 427/68, 64, 66; 445/24, 52, 58; 313/496

[56] References Cited

U.S. PATENT DOCUMENTS 4,339,524 7/1982 Ichimura et al. ..... 525/61
5,021,505 6/1991 Ichimura et al. ..... 525/59
5,510,154 4/1996 Itoh et al. ..... 427/526
5,547,411 8/1996 Lee ..... 445/52
5,644,190 7/1997 Potter ..... 313/336
5,723,224 3/1998 Toki et al. ..... 428/570
5,789,856 8/1998 Itoh et al. ..... 313/496

FOREIGN PATENT DOCUMENTS 602838 8/1960 Canada .
58-192243 11/1983 Japan .
61-24123 2/1986 Japan ..... 427/68

OTHER PUBLICATIONS

Ichimura et al., "Preparation and Charachtoristics of Photocrosslinkable PVA", J. Polymer Sci. vol. 20(6) pp. 1419–1432, Jan. 1982.
Ichimura et al. Abstract of JP 56–147804, Nov. 1981.
Srivastava et al. "Phosphors" in Kirk–Othmer Encyclopedia of Chemical Technology, vol. 15, pp. 562–584, 1995.
Abstract of JP 56–147804, Nov. 1981.

*Primary Examiner*—Martin Angebranndt
*Attorney, Agent, or Firm*—Oblon, Spivak, McClelland, Maier & Neustadt, P.C.

[57] ABSTRACT

The present invention relates to a composition for forming a fluorescent film for a display and a method of forming a fluorescent film for forming a display surface of a display unit. The composition for forming a fluorescent film for a display has an aqueous medium in which photosensitive resin having a styryl pyridium photosensitive group having an internal salt structure and a fluorescent material which easily reacts with acid are dispersed. The composition is applied to the display surface of a display unit so that a fluorescent layer is formed. Then, the fluorescent material layer is developed to form the fluorescent material layer into a predetermined pattern, and then the fluorescent material layer formed into the predetermined pattern is baked so that a fluorescent film is formed.

16 Claims, 4 Drawing Sheets

COMPOSITION FOR FORMING FLUORESCENT FILM FOR DISPLAY AND METHOD OF FORMING FLUORESCENT FILM FOR DISPLAY

BACKGROUND OF THE INVENTION

1. Field of the Invention

The present invention relates to a composition for forming a fluorescent film on a surface of the screen of a variety of display units and to a method of forming a fluorescent film for a display by using the composition above.

2. Description of Prior Art

A graphic fluorescent display tube, serving as a display unit, has a fluorescent film composed of a multiplicity of pixels to selectively cause the pixels to emit light by using collision of electrons so as to display an arbitrary graphic image. The fluorescent surface of the graphic fluorecent display tube is composed of, for example, fluorescent material ZnO:Zn when the graphic display tube is arranged to display a monochrome image. When the graphic display tube is arranged to display a full color image, a fluorescent film must be formed which is composed of a multiplicity of pixels by using fluorescent materials capable of emitting green (G), red (R) and blue (B) light. The fluorescent materials for use in the full color graphic display tube are, for example, ZnS:Cu, Al, which is a fluorescent material capable of emitting green (G) light, $Y_2O_2S$:Eu, which is a fluorescent material capable of emitting red (R) light and ZnS:Ag,Al which is a fluorescent material capable of emitting blue (B) light.

As a method of forming the fluorescent film into a predetermined pattern on the surface of a substrate or the like by using the above-mentioned fluorescent materials, a screen printing method, an electrodeposition method, a photolithography method and a slurry method have been known. However, the electrodeposition method is not a preferred method when a predetermined pattern must be formed by using the three types of fluorescent materials for green (G), red (R) and blue (B) light, as is required for the above-mentioned full color graphic fluorescent display tube, because undesired fluorescent materials are physically allowed to adhere. For example, a color CRT employs the slurry method to precisely pattern the three types of fluorescent materials for emitting green (G), red (R) and blue (B) light.

The slurry method has the step of mixing ammonium dichromate (ADC) as a photosensitive material with PVA (polyvinyl alcohol) water soluble resin so that photosensitive resin solution is prepared. Then, fluorescent particles are mixed with the solution so that slurry solution for use as a composition for forming a fluorescent film for a display is obtained. The side on which the fluorescent film will be formed, that is, a glass substrate having a surface on which the fluorescent film will be formed, is uniformly coated with the slurry solution, followed by drying the wet surface. Then, the glass substrate is irradiated with ultraviolet rays through a mask having a predetermined mask, and then water development is performed so that the portion exposed to the ultraviolet rays is retained. The foregoing process is repeated for each of the green, red and blue fluorescent materials. Then, the glass substrate is baked in an oxidizing atmosphere to decompose PVA and ADC with heat so as to evaporate and remove the same. Thus, the fluorescent film is formed.

If ADC is used as the photosensitive material in the slurry method, chrome oxide (CrO) is left on the surface of the fluorescent film after the baking process has been performed because ADC contains Cr. Cr is known to serve as a component for killing light emission even if Cr is contained in the fluorescent material in a small quantity. In a case of the CRT in which light emission is caused to take place in the inside portion of the fluorescent material by using high-speed electron beams, the killer effect can be prevented. However, the luminous efficiency of a fluorescent material of a type which emits light with relatively low speed electron beams (for example, acceleration voltage: 0.1 kV to 2 kV) sometimes deteriorates by 50% or more because of the killer effect above.

As another method of forming a fluorescent film capable of preventing retention of the killer in the fluorescent film, a PVA-SbQ method has been known. In this method, water soluble photosensitive resin is employed as the photosensitive material which has PVA as the main chain thereof and styryl pyridium group (abbreviated as a "SbQ group") as a side chain thereof to serve as the photosensitive group. The photosensitive material above is used similarly as is used in the slurry method in which ADC is used as the photosensitive material. PVA-SbQ is expressed by the following formula:

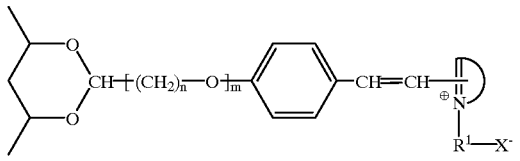

wherein $R^1$ is an alkyl group or aralkyl group, $X^-$ is a negative ion, m is 0 or 1, n is an integer 1 to 6, and

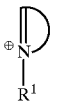

is a quaternary aromatic heterocyclic group containing nitrogen.

Since the PVA-SbQ method does not use heavy metal, such as Cr. which is used in ADC, the light emission characteristic of the fluorescent material is not adversely effected. However, research and development performed by the inventors of the present invention proved that the SbQ group has intense ionicity similarly to ADC and thus, a fluorescent material having low tolerance to acid, for example, $ZnGa_2O_4$:Mn fluorescent material, can be damaged by ions of the SbQ group.

A fact has been found that use of a sulfide type fluorescent material for use in a general television display unit as a color fluorescent material for FED (Field Emission Display) results in the sulfide being scattered and the emitter being contaminated. In this case, a problem of reliability arises in that, for example, the lifetime of the FED deteriorates.

Accordingly a non-sulfide fluorescent material must be used as the fluorescent material for the FED in place of the sulfide fluorescent material. As a non-sulfide type fluorescent material capable of emitting green light, it might be considered to employ $ZnGa_2O_4$:Mn which is an oxide fluorescent material. However, when $ZnGa_2O_4$:Mn generally having poor tolerance to acid is mixed and dispersed in slurry solution containing the SbQ having the external salt structure, the surfaces of fluorescent material particles are denatured and, therefore, the luminous efficiency deteriorates. This phenomenon can be considered to be attributable to the inonicity of the SbQ group.

SUMMARY OF THE INVENTION

An object of the present invention is to provide a composition for forming a fluorescent film for a display containing a photosensitive group having a low ionicity and therefore preventing adverse influence on the fluorescent material and to a method of forming a fluorescent film for a display using the composition for forming a fluorescent film for a display. More particularly, an object of the present invention is to provide a composition for forming a fluorescent film for a display and composed of $ZnGa_2O_4$: Mn exhibiting excellent luminous efficiency with relatively low speed electron beams, the acceleration voltage of which is about 0.1 to 2.0 kV and having satisfactory reliability for a FED and to a method of forming a fluorescent film for a displaying using the composition above. Since the $ZnGa_2O_4$:Mn fluorescent material has a small particle size and irregular shape different from the spherical shape of the general fluorescent material for a television display, the filling density is lowered when the $ZnGa_2O_4$:Mn has been formed into a film and thus the patterning characteristic deteriorates. If the patterning characteristic is unsatisfactory, there arises a problem when a fluorescent surface is formed by patterning plural types of fluorescent materials into a predetermined shape such that, for example, the fluorescent surface of a full color graphic fluorescent display tube is formed by applying G,R and B fluorescent materials by three processes into a predetermined pattern, the fluorescent materials for emitting R (red) and B (blue) light are allowed to adhere to the film made of the fluorescent material for emitting G (green) formed by a first color coating process. Thus, colors formed by emitted light are unintentionally mixed.

Accordingly, a second object of the present invention is to provide a method of forming a fluorescent surface by using an overcoat material in order to pattern fluorescent materials without occurrence of unintentional color mixture when a fluorescent surface made of plural types of fluorescent materials is formed on an insulating surface by using a material for forming a fluorescent surface.

According to one aspect of the present invention, there is provided a composition for forming a fluorescent film for a display, including an aqueous medium in which photosensitive resin having a styryl pyridium photosensitive group having an internal salt structure and a fluorescent material which easily reacts with acid are dispersed.

According to another aspect of the present invention, there is provided a method of forming a fluorescent film for a display, including the steps of: coating a surface with a composition for forming a fluorescent film for a display, having a fluorescent material which easily reacts with photosensitive rein having a styryl pyridium photosensitive group having an internal salt structure, so as to form a fluorescent material layer; selectively performing exposure by irradiating the upper surface of the fluorescent material layer with ultraviolet rays and developing the fluorescent material layer to form the fluorescent material layer into a predetermined pattern; and baking the fluorescent material layer formed into a predetermined pattern.

According to another aspect of the present invention, there is provided a method of forming a fluorescent film for a display, including the steps of: forming an anode conductor on a predetermined surface; coating the surface of the anode conductor with a composition for forming a fluorescent film for a display, having photosensitive rein having a styryl pyridium photosensitive group having an internal salt structure and a fluorescent material which easily reacts with acid, to form a fluorescent material layer; selectively performing exposure by irradiating the upper surface of the fluorescent material layer with ultraviolet rays and developing the fluorescent material layer to form the fluorescent material layer into a predetermined pattern; and baking the fluorescent material layer formed into a predetermined pattern.

According to another aspect of the present invention, there is provided a method of forming a fluorescent film for a display, including the steps of: forming an anode conductor on a predetermined surface; forming a precoat film on the anode conductor; coating the surface of the precoat film with a composition for forming a fluorescent film for a display, having photosensitive rein having a styryl pyridium photosensitive group having an internal salt structure and a fluorescent material which easily reacts with acid, to form a fluorescent material layer; selectively performing exposure by irradiating the upper surface of the fluorescent material layer with ultraviolet rays and developing the fluorescent material layer to form the fluorescent material layer into a predetermined pattern; and baking the fluorescent material layer formed into a predetermined pattern.

According to another aspect of the present invention, there is provided a method of forming a fluorescent film such that a fluorescent film made of plural types of fluorescent materials is formed on an insulating surface, the method of forming a fluorescent film including the steps of: applying a material for forming a fluorescent film containing first photosensitive resin having a styryl pyridium photosensitive group having an internal salt structure and a fluorescent material to the surface of an insulating surface to form a fluorescent material layer; applying an overcoat material containing second photosensitive resin to the surface of the fluorescent material layer to form an overcoat layer; and selectively performing exposure by irradiating the overcoat layer with ultraviolet rays and then developing the overcoat layer so as to form the fluorescent material layer and the overcoat layer into predetermined patterns, wherein at least one fluorescent material of the plural types of the fluorescent materials is subjected to the above-mentioned steps.

According to another aspect of the present invention, there is provided a method of forming a fluorescent film such that a fluorescent film made of plural types of fluorescent materials is formed on an insulating surface, the method of forming a fluorescent film including the steps of: forming an anode conductor on the glass substrate; applying a material for forming a fluorescent film containing first photosensitive resin having a styryl pyridium photosensitive group having an internal salt structure and a fluorescent material to the surface of the anode conductor to form a fluorescent material layer; applying an overcoat material containing second photosensitive resin to the surface of the fluorescent material layer to form an overcoat layer; and selectively performing exposure by irradiating the overcoat layer with ultraviolet rays and then developing the overcoat layer so as to form the fluorescent material layer and the overcoat layer into predetermined patterns, wherein at least one fluorescent material of the plural types of the fluorescent materials is subjected to the above-mentioned steps.

According to another aspect of the present invention, there is provided a method of forming a fluorescent film such that a fluorescent film made of plural types of fluorescent materials is formed on an insulating glass substrate, the method of forming a fluorescent film including the steps of: applying a material for forming a fluorescent film containing first photosensitive resin having a styryl pyridium photosensitive group having an internal salt structure and a fluorescent material to the surface of a glass plate to form a fluorescent material layer; applying an overcoat material containing second photosensitive resin to the surface of the fluorescent material layer to form an overcoat layer; and selectively performing exposure by irradiating the overcoat layer with ultraviolet rays and then developing the overcoat layer so as to form the fluorescent material layer and the overcoat layer into predetermined patterns, wherein at least one fluorescent material of the plural types of the fluorescent materials is subjected to the above-mentioned steps so that a fluorescent surface is formed, and then med on the fluorescent film.

Other objects, features and advantages of the invention will be evident from the following detailed description of the preferred embodiments described in conjunction with the attached drawings.

DESCRIPTION OF THE PREFERRED EMBODIMENTS

According to the present invention, there is provided a composition for forming a fluorescent film for a display prepared by using PVA-SbQ having an internal salt structure which is different from conventional PVA-SbQ having an external salt structure. PVA-SbQ expressed by the following formula having the internal salt structure is stable ion characteristic and therefore it does not, in terms of ions, adversely affect, a fluorescent material having poor tolerance to acid, for example $ZnGa_2O_4$:Mn which is a fluorescent material capable of emitting green light.

Figure 1:
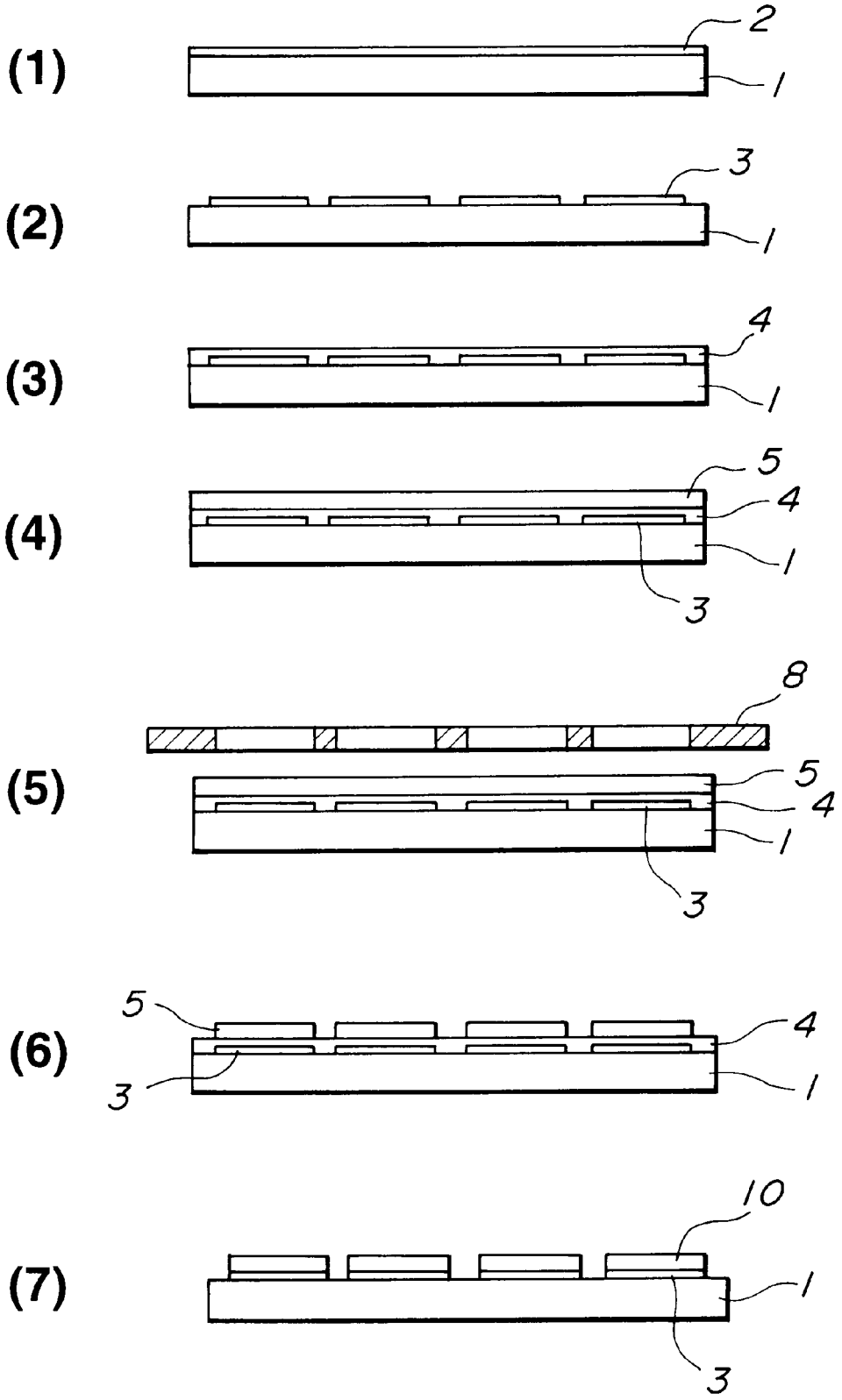
FIG. 1 is diagram showing manufacturing steps according to a first embodiment of the present invention.

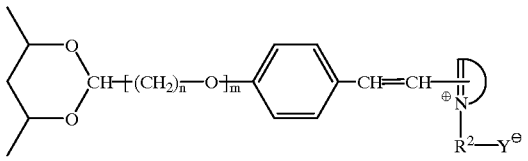

wherein $R^2$ is an alkylene group and $Y^{\ominus}$ is $SO_3^{\ominus}$ or $CO_2^{\ominus}$ A first embodiment of the present invention will now be described with reference to FIG. 1.

A process will now be described in which a fluorescent film is formed on the surface of a glass substrate by using a $ZnGa_2O_4$:Mn fluorescent material which is a fluorescent material having poor tolerance to acid and which is capable of emitting green light. Referring to fractional numbers (1) to (7) of FIG. 1, the process will now be described.

(1) A glass substrate 1 is cleaned by a usual wet cleaning method using water, and then dry cleaning is performed by using ultraviolet rays and ozone. A sputtering method is employed to form an ITO (Indium Tine Oxide) film 2 on the overall surface of the glass substrate 1. The thickness of the ITO film 2 is 0.1 to 0.15 $\mu$m and the sheet resistance is tens of Å/□).

(2) A photolithography method is employed to pattern the ITO film 2 into an anode conductor 3 having a predetermined shape. The anode conductor 3 is formed into a divided parallel stripe pattern or a pixel shape pattern divided for each fluorescent material.

(3) A spinner is used to form a precoat film 4 on the patterned anode conductor 3 and the glass substrate 1. That is, precoat solution is placed on the glass substrate 1, and then the spinner is used to rotate the glass substrate 1 so as to spread the precoat solution on the glass substrate 1. The precoat solution is solution prepared by adding a surface active agent to 0.2 wt % PVA. The precoat solution is spread under condition that the number of revolutions of the spinner is 1000 r/m and the spinner is rotated for 10 seconds. Then, the precoat solution is dried at 150° C. for 5 minutes. As a result of the operation performed under the foregoing condition, a precoat film 4 having a thickness of 0.05 $\mu$m is uniformly formed on the anode conductor 3 and the glass substrate 1.

(4) A step for forming a fluorescent material layer (green fluorescent material layer) using a fluorescent material capable of emitting green light will now be described. The composition ratio of green slurry solution, which is a composition for forming a fluorescent film for a display for use to form the green fluorescent-material layer 5 is as follows:

| | |
|---|---|
| Green Fluorescent Material ($ZnGa_2O_4$:Mn) | 23 wt % |
| Photosensitive Material | 23 wt % |
| Dispersant 1 (Emulgen 913) | 1 wt % |
| Dispersant 2 (LT-221) | 1 wt % |
| Pure Water | 52 wt % |

The photosensitive material is water soluble styryl pyridium photosensitive resin having a photosensitive group having an internal salt structure. An example of a method of preparing the foregoing photosensitive material will now be described. 5 g of polyvinyl alcohol EG-40 (manufactured by Nihon Gosei Chemical Industry and having a polymerization degree of 2,000 and a saponification ratio of 88%) was dissolved in a mixture solvent composed of 62 g of water and 18 g of isopropylalcohol. Then, 1.1 g of 4-(p-formylstyryl) pyridinium-1-ethylsulfonate and 0.3 g of 85% phosphoric acid were added to the foregoing solution, and then the prepared solution was stirred at 30 to 40° C. for 20 hours. The reactant mixture was injected into acetone so that white polymer was precipitated. The precipitated polymer was sufficiently cleaned with methanol, and then vacuum-dried so that 4.70 g of polyvinyl alcohol derivative was obtained. The bonding ratio of the styryl pyridinium compound to polyvinyl alcohol obtained by ultraviolet spectrophotometry was 1.4 mol %. The thus-obtained polyvinyl alcohol derivative was prepared into 10 wt % solution. The foregoing dispersant is 0.5 wt %.

The green slurry solution manufactured to have the above-mentioned composition ratio had viscosity of 18 mPas and pH of 5.2. The green slurry solution is applied to the upper surface of the precoat film 4 so that the green fluorescent-material layer 5 is formed. The condition under which the green fluorescent-material layer 5 is formed is such that the spinner revolution speed is 150 r/m, the spinner is rotated for 10 seconds and the green fluorescent-material layer 5 is dried at 70° C. for 2 minutes. As a result, the green fluorescent-material layer 5 is formed which has screen weight of 1.4 mg/cm$^2$.

(5) Then, an exposure process is performed such that a mask 8 having a pattern for the green fluorescent-material layer 5 is placed on the green fluorescent-material layer 5 so as to be exposed to ultraviolet rays. The green fluorescent-material layer 5 irradiated with ultraviolet rays is hardened so as to be insoluble in water. A quantity of exposure of 40 $mJ/cm^2$ is sufficient to form a uniform pattern.

(6) The green fluorescent-material layer 5 subjected to the exposure process is subjected to a water development process by a spray method. The development is performed under following conditions:

| | |
|---|---|
| Temperature of Pure water | 40° C. |
| Spraying Pressure | 2 $kgf/cm^2$ |
| Time for Which Development is performed | 40 seconds |
| Spray Nozzle | 110° Flat Nozzle |

As a result of the foregoing development conditions, the green fluorescent-material layer 5 was formed into a predetermined pattern corresponding to the anode conductor 3.

(7) The glass substrate is baked. The baking operation is performed in an acidic atmosphere at a baking temperature of 400 to 500° C., preferably 430 to 450° C. The time for which the baking operation is performed is 10 minutes to 20 minutes. Components in the green slurry except for the fluorescent material and the precoat film 4 are decomposed with heat and thus evaporated. As a result, the fluorescent film 10 applied to the surface of the anode conductor 3 is formed on the glass substrate 1.

In order to make a comparison with the fluorescent film formed as described above, green slurry solution containing photosensitive resin having a styryl pyridinium photosensitive group in the form of an external salt structure and $ZnGa_2O_4$:Mn fluorescent material is prepared to form a green fluorescent film on a glass substrate. The other components and the composition of the slurry solution are the same as those of the first embodiment. The slurry solution prepared under the foregoing conditions had viscosity of 15 mPas and pH of 6.7. The comparative slurry solution was used to form a comparative fluorescent film under the same steps as those of the first embodiment.

The glass substrate, on which the green fluorescent film according to the first embodiment has been formed, and the glass substrate, on which the comparative green fluorescent film has been formed, are used to respectively serve as anode substrates to manufacture field emission displays. That is, a cathode substrate having a field emission type cathode on the inner surface thereof is disposed to face each glass substrate, followed by sealing the outer surface of each substrate so as to exhaust internal gas to realize a high vacuum state. Drive voltage is applied to the anode conductor to operate the field emission cathode so that electrons are emitted. Electrons collides with the fluorescent film of the anode so as to cause the fluorescent film to emit light. Light emission can be observed from outside of the anode substrate through the anode conductor and the anode substrate.

Assuming that the luminous efficiency of the FED having the fluorescent film according to the comparative example was 100, the luminous efficiency of the FED having the fluorescent film according to this example exhibited a significant luminous efficiency of 143. That is, this embodiment improved the luminous efficiency by 43% as compared with the conventional fluorescent film having the external salt structure.

Since the surfaces of particles of the $ZnGa_2O_4$:Mn fluorescent material of the fluorescent film cannot be denatured by the ionic characteristic of the slurry solution according to this embodiment, the luminous efficiency of the fluorescent material does not deteriorate. Therefore, the obtained fluorescent film emit intense light with electrons accelerated with voltage of 0.1 kV to 2.0 kV. The fluorescent film according to this embodiment is an advantageous fluorescent film of a fluorescent material capable of emitting green light in place of, for example, the sulfide fluorescent material which contaminates the emitter because the sulfide scatters. Also in a case where a full color FED is manufactured, use of the $ZnGa_2O_4$:Mn fluorescent material to form the fluorescent film capable of emitting green light improves the reliability.

Although the foregoing embodiment has the step in which the slurry solution serving as the composition for forming a fluorescent film for a display containing the photosensitive rein and the fluorescent material is applied to the surface of the glass substrate by the slurry method, a method except the slurry method may be employed to coat the surface of the glass substrate with the composition for forming a fluorescent film for a display.

Figure 2:
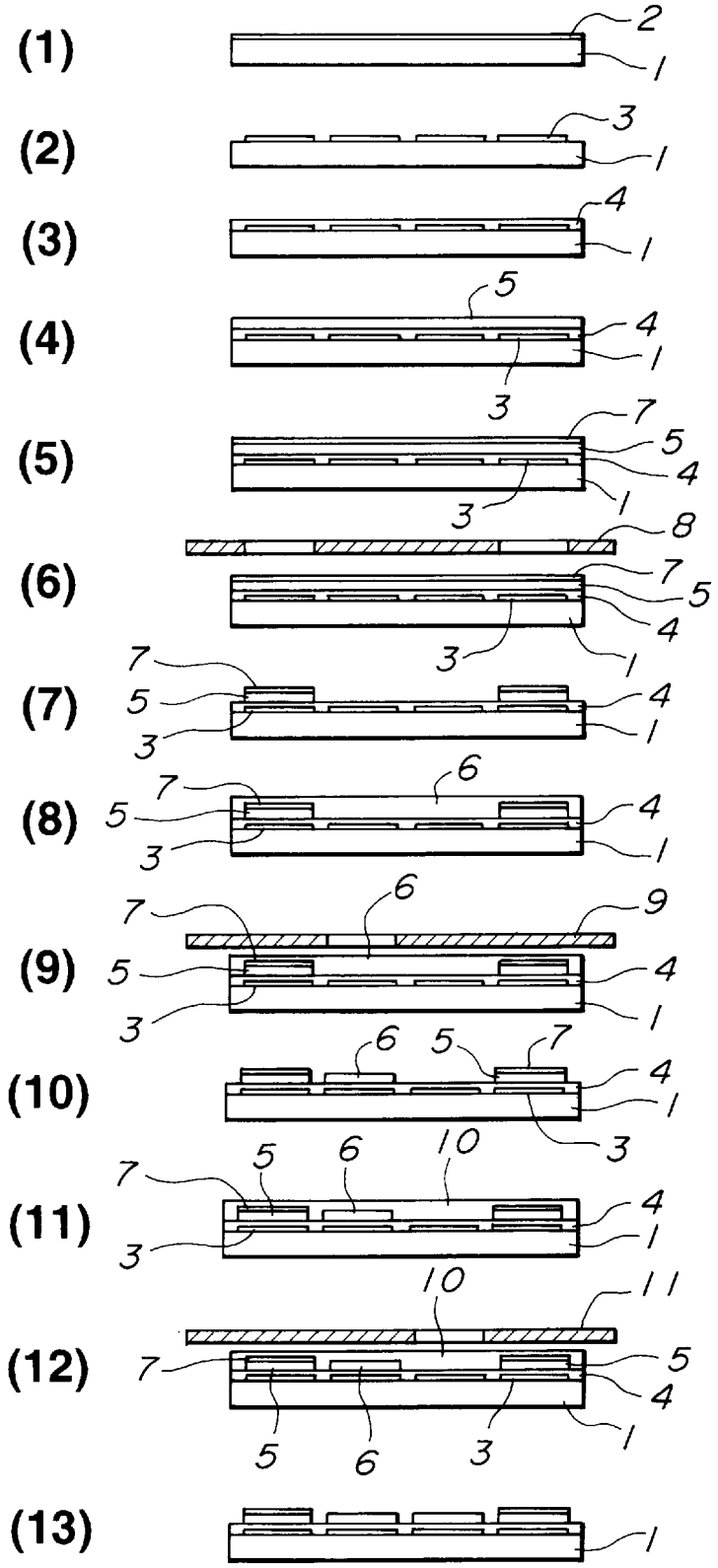
FIG. 2 is diagram showing manufacturing steps according to a second embodiment of the present invention.

A second embodiment of the present invention will now be described with reference to FIG. 2.

This embodiment relates to a method of forming a fluorescent film for a full color graphic FED capable of emitting intense light when applied with electron beams at acceleration voltage of 0.1 kV to 2 kV. The method according to this embodiment will now be described with reference to fractional numbers (1) to (13) of FIG. 2. Since the steps shown in fractional numbers (1) to (4) of FIG. 2 for forming the green fluorescent film of the fluorescent film for the full color graphic FED are the same as those according to the first embodiment, they are omitted from description. Then, steps for forming a red fluorescent film and a blue fluorescent film shown fractional numbers (5) to (13) of FIG. 2 will now be described.

(5) As shown in fractional number (5) of FIG. 2, unintentional color mixture of particles of red fluorescent material with the green fluorescent-material layer 5 is prevented by forming an overcoat layer 7 made of an overcoat material on the green fluorescent-material layer 5 prior to forming a second fluorescent material layer (a red fluorescent-material later 6) by using a fluorescent material capable of emitting red light. As a matter of course, the foregoing process is a process to be performed prior to performing the processes for exposing and developing the green fluorescent-material layer 5.

The overcoat material is an organic solvent type photosensitive material, the surface of which has a physical and chemical properties considerably different from the water soluble PVA-SbQ photosensitive material for use in the green slurry solution. The composition ratio of the overcoat material is as follows:

| | |
|---|---|
| Photosensitive Material | 30 wt % |
| Propylene Glycol Monomethyl Ether | 70 wt % |

The photosensitive material is organic solvent type photosensitive resin which can be developed with water and which contains hydroxypropylcellulose and a photooxidation generating material. An example of a method of preparing the foregoing photosensitive material will now be described.

| | |
|---|---|
| Hydroxypropylcellulose | 2.4 wt % |
| Photooxidation Generating Material (PAG-1) | 0.2 wt % |
| Methylated Melamine resin (MS-21) | 0.4 wt % |
| Solvent (PGM) | 97.0 wt % |

PAG-1 above is 2 (2'-furylethylidene)-4, 6-bis (trichloromethyl)-S-triazine. As the photooxidation generating material, a triazine compound, for example, a bis (trihalomethyl)-1, 3, 5-triazine compound, and, for example, 2-halomethyl-1, 3, 4-oxadiazole derivative may be employed. Moreover, PAG-1 may be any one of onium salts, such as triphenyl sulfonic acid, diphenyliodenium salt and phenyldiazonium salt; or any one of the following derivatives of sulfonic acid:

1, 2-naphthoquinonediazide-4-sulfonylchloride, 1, 2-naphthoquinonediazide-4-sulfonate, a 1, 2-naphthoquinonediazide-4-sulfonamide compound, a nitrobenzyl sulfonate compound, arylsulfonate, and iminosulfonate may be employed.

The PGM is propylglycol monomethylether.

The above-mentioned overcoat material is applied to the surface of the green fluorescent-material layer 5 under the following conditions so that an overcoat layer 7 is formed. The forming conditions are such that the spinner revolution speed is 200 r/m, the time for which the spinner is rotated is 10 seconds and the overcoat material is dried at 60° C. for 2 minutes.

(6) A mask 8 having a pattern for the green fluorescent-material layer 5 formed thereon is placed on the overcoat layer 7 and the green fluorescent-material layer 5, and then an exposure process is performed in which ultraviolet rays are applied. The overcoat layer 7 and the green fluorescent-material layer 5 irradiated with ultraviolet rays are simultaneously hardened to be insoluble to water. A quantity of exposure of 40 mJ/cm$^2$ is sufficient to form a uniform pattern.

(7) The overcoat layer 7 and the green fluorescent-material layer 5 subjected to the exposure process are subjected to a water development process by a spray method. The development is performed under the following conditions:

| | |
|---|---|
| Temperature of Pure water | 40° C. |
| Spraying Pressure | 2 kgf/cm$^2$ |
| Time for Which Development is performed | 40 seconds |
| Spray Nozzle110 Flat Nozzle | 110° Flat Nozzle |

As a result of the foregoing development conditions, the green fluorescent-material layer 5 and the overcoat layer 7 on the green fluorescent-material layer 5 were formed to have the same patterns. The green fluorescent-material layer 5 covered with the overcoat layer 7 had considerably smooth surface and the cross sections of the edges. Moreover, the surface of the green fluorescent-material layer 5 had considerably poor affinity with the water soluble PVA-SbQ which was the photosensitive material for the green slurry solution.

(8) A step for forming the second fluorescent material layer (the red fluorescent-material later 6) using a fluorescent material capable of emitting red light will now be described. The composition ratio of red slurry solution, which is a material for forming a fluorescent surface for forming the red fluorescent-material later 6, is as follows:

| | |
|---|---|
| Red Fluorescent Material ($SrTiO_3$:Pr) | 22 wt % |
| Photosensitive Material | 25 wt % |
| Dispersant 1 (Emulgen 913) | 1 wt % |
| Dispersant 2 (LT-221) | 1 wt % |
| Pure Water | 52 wt % |

The photosensitive material is solution of 10 wt % water soluble resin having the same composition as that of the green slurry solution. The dispersant is 0.5 wt % solution. The slurry solution prepared with the above-mentioned composition ratio having viscosity of 15 mPas is applied to the surface of the green fluorescent-material layer 5 covered with the overcoat layer 7 so that the red fluorescent-material later 6 is formed. The red fluorescent-material later 6 is formed under conditions that the spinner is rotated at a revolution speed of 150 r/m, the time for which the spinner is rotated is 10 seconds and the applied slurry solution was dried at 70° C. for 2 minutes. As a result, red slurry solution having a screen weight of 1.2 mg/cm$^2$ is applied.

(9) Then, an exposure process is performed such that a mask 9 having a pattern for the red fluorescent-material layer 6 is placed on the red fluorescent-material layer 6 so as to be exposed to ultraviolet rays. The red fluorescent-material layer 6 irradiated with ultraviolet rays is hardened so as to be insoluble to water.

(10) The red fluorescent-material later 6 subjected to the exposure process is subjected to a water development process under substantially the same conditions as those for the green fluorescent-material layer 5. Thus, the red fluorescent-material later 6 is formed into a predetermined pattern. At this time, no particle of the red fluorescent material is placed on the first green fluorescent-material layer 5 covered with the overcoat layer 7. As a result, color mixture can completely be prevented.

(11) A step for forming a third color fluorescent material layer (a blue fluorescent-material later 20) using a fluorescent material capable of emitting blue light will now be described. The blue fluorescent-material later 20 was made of $Y_2SiO_5$:Ce. The components of the blue slurry solution except the fluorescent material and the conditions under which the blue fluorescent-material later 20 is formed are substantially the same as those under which the red fluorescent-material later 6 is formed. The blue slurry solution is applied to cover the patterned green fluorescent-material layer 5 covered with the overcoat layer 7 and the patterned red fluorescent-material later 6.

(12) A mask 11 having a pattern for the blue fluorescent-material later 20 formed thereon is placed, and then an exposure process is performed. The blue fluorescent-material later 20 irradiated with ultraviolet rays is hardened to be insoluble to water.

(13) The exposed blue fluorescent-material later 20 is developed with water so that the blue fluorescent-material later 20 is formed into a predetermined and uniform pattern. Also at this time, no particle of the blue fluorescent material is placed on the green fluorescent-material layer 5 which is covered with the overcoat layer 7 and which is the first color. Therefore, the problem of the color mixture was completely solved.

Although omitted from illustration, the glass substrate 1 is baked at a proper temperature level so as to remove the overcoat layer 7 and the precoat film 4. As a result, a fluorescent surface covered with the red, green and blue fluorescent materials in the form of predetermined patterns can be obtained on each anode conductor 3 formed into a predetermined pattern.

Although the foregoing embodiments have the structure such that the overcoat layer 7 is formed on only the green fluorescent-material layer 5, which is the first color layer, the overcoat layer 7 may be formed on also the red fluorescent-material later 6, which is the second color surface. Moreover, the sequential order for forming the green, red and blue fluorescent material layers may be changed.

Figure 3:
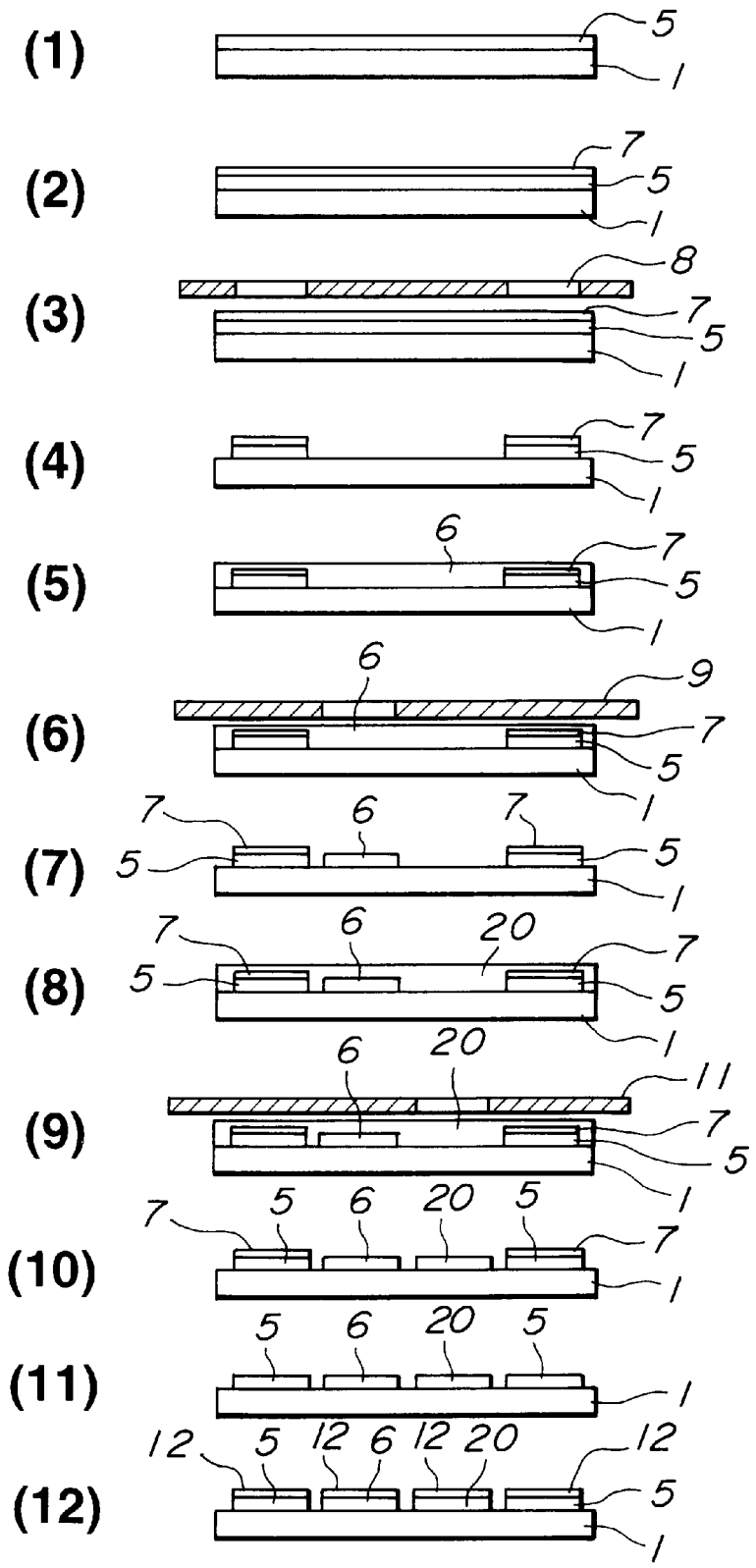
FIG. 3 is diagram showing manufacturing steps according to a third embodiment of the present invention.

A third embodiment of the present invention will now be described with reference to FIG. 3.

This embodiment relates to a method of forming a fluorescent surface which is adaptable to a display unit, such as a CRT, which is operated at voltage higher than that for the above-mentioned graphic FED. The fluorescent surface has a structure such that patterns of green, red and blue fluorescent material layers are directly formed on the surface of a glass substrate or the like, and a metal layer is formed on the foregoing patterns. The description will be performed with reference to fractional numbers (1) to (12) of FIG. 3. If the composition of the employed materials, the forming conditions and the obtainable effect are similar to those of the first embodiment, the similar elements are omitted from description.

(1) A glass substrate 1 is cleaned, and then green slurry solution is applied to the overall surface of the glass substrate 1 so that a green fluorescent-material layer 5 is formed.

(2) An overcoat layer 7 is formed on the green fluorescent-material layer 5 applied to the glass substrate 1.

(3) A mask 8 having a pattern for the green fluorescent material layer formed thereon is placed on the overcoat layer 7 and the green fluorescent-material layer 5, and then an exposure process is performed.

(4) A development process is performed so as to pattern the green fluorescent-material layer 5.

(5) Red slurry solution is applied to the surfaces of the green fluorescent-material layer 5 covered with the overcoat layer 7 so as to form a red fluorescent-material later 6.

(6) A mask 9 having a pattern for the red fluorescent-material later 6 formed thereon is placed on the red fluorescent-material later 6, and then an exposure process is performed.

(7) A development process is performed so as to pattern the red fluorescent-material later 6.

(8) Blue slurry solution is applied to the surfaces of the green fluorescent-material layer 5 and the red fluorescent-material later 6 covered with the overcoat layer 7 so that a blue fluorescent-material later 20 is formed.

(9) A mask 11 having a pattern for the blue fluorescent material layer formed thereon is placed on the blue fluorescent-material later 20, and then an exposure process is performed.

(10) A development process is performed so that the blue fluorescent-material later 20 is patterned.

(11) The glass substrate 1 is baked so as to remove the overcoat layer 7 so that a fluorescent surface coated with the red, green and blue fluorescent materials in the form of predetermined patterns is obtained.

Figure 4:
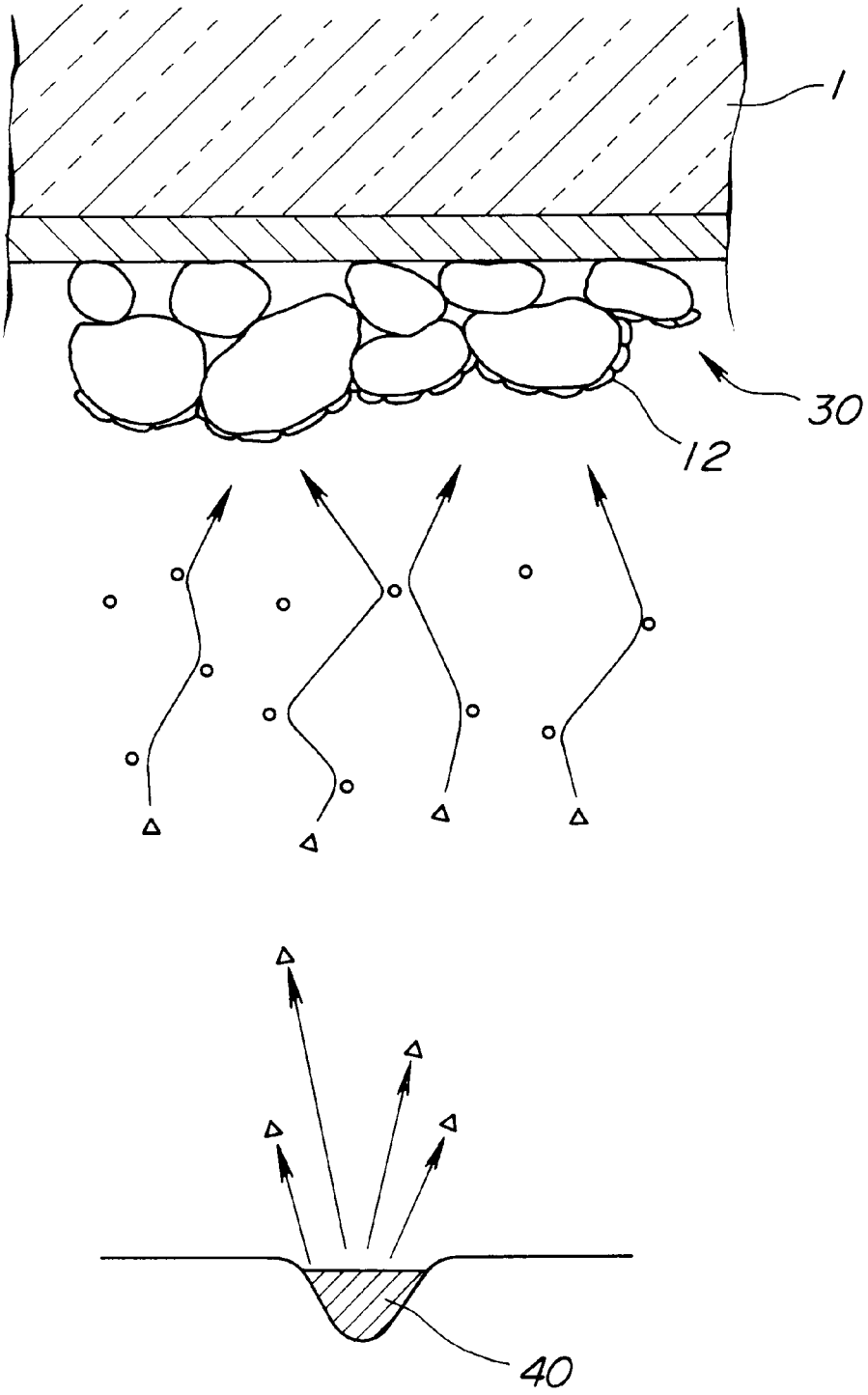
FIG. 4 is a schematic view showing a state where an aluminum film is formed on a fluorescent surface according to the third embodiment of the present invention.

(12) The fluorescent surface is coated with an aluminum film 12 which is a metal layer. The aluminum film 12 is called as "metal back" in the conventional CRT. The aluminum film for use as the metal back or the like in the conventional CRT or the like has a structure formed by stacking spherical aluminum particles each having a small diameter to have a large thickness of 2000 Å to 1 $\mu$m. However, the aluminum film 12 according to this embodiment is, as shown in FIG. 4, which is a view of explanatory showing a manufacturing method to be described later, formed into a structure such that aluminum particle each of which is deformed flatly are densely applied to the surface of the particles of the fluorescent material. The thickness is hundreds of Å to less than 2000 Å (preferably about 400 to about 500 Å which is smaller than that of the conventional aluminum film.

The aluminum film 12 is formed by using masks (not shown) corresponding to the red, green and blue patterns on the fluorescent surface by an evaporation method. In this step, means for heating a material to be evaporated, means for heating the base on which the material is evaporated and a vacuum container having a vacuum apparatus are used. As shown in FIG. 3, aluminum 40 which is a substance to be evaporated and glass substrate 1 on which the aluminum 40 is evaporated are introduced into the vacuum container. Then, the inside portion of the vacuum container is brought to a high vacuum state not lower than $1\times10^{-5}$ Torr. Then, inert gas, such as He, is introduced into the vacuum container by about several Torr to about $1\times10^{-2}$ Torr so that an inert gas atmosphere is realized.

The aluminum 40 in the vacuum container is heated to a level higher than the melting point by heating means, such as electron beams or resistance heat so as to evaporate the aluminum 40. At this time, also the glass substrate 1 in the vacuum container is heated. It is preferable that the temperature, to which the glass substrate 1 is heated, be a level which is near the melting point of the substance to be evaporated and with which the glass substrate 1 is not damaged. In this embodiment, the temperature is set to be 360 to 400° C. which is, by 300° C., lower than 660° C. which is the melting point for aluminum.

As shown in FIG. 4, aluminum molecules (indicated by symbol Δ) repeatedly collide with He molecules (indicated by symbol ○) so that the energy is attenuated. When the aluminum molecules reach the fluorescent surface of the glass substrate 1, the difference in the temperature between the aluminum molecules and the glass substrate 1 heated to about 400° C. is reduced. Therefore, the aluminum molecules are, as shown in FIG. 4, enlarged as flat and large particles on the surface of the particles of the fluorescent material in the fluorescent surface 30. As a result, a very thin and dense aluminum film 12 having no pore is uniformly formed on the surface of the fluorescent surface.

The degree of flattening of aluminum particles is such that the length of flattening is about 30 with respect to thickness 1. Therefore, if the aluminum film 12 is formed by particles in one layer having a thickness of about 400 to about 500 Å (about 0.04 to about 0.05 $\mu$m), the radius of each aluminum particle is about 12000 to about 15000 Å (about 1.2 to about 1.5 $\mu$m).

Although the step according to this embodiment has the structure such that the inside portion of the vacuum container is made to be the He atmosphere, another inert gas (Ne, Ar, Kr, Xe or Rn) may be employed. Although the aluminum film 12 is formed as the metal film, metal which does not react with the fluorescent material and which has a relatively low melting point may be employed to form a metal film having a structure similar to that of the aluminum film 12. For example, copper can be employed.

The glass substrate 1 having the patterns of the red, green and blue fluorescent material layers manufactured by the above-mentioned steps are used to form a vacuum container and an electron gun is provided in the vacuum container to enable electrons to collide with the aluminum film 12 on the fluorescent surface so that a CRT exhibiting excellent brightness and free from mixture of color fluorescent materials is obtained.

Although each of the foregoing embodiments has the structure such that the slurry solution is, as the material for forming the fluorescent surface including the photosensitive resin and the fluorescent materials, applied to the surface of the glass substrate 1 by the slurry method, another method may be employed in place of the slurry method to apply the material for forming the fluorescent surface to the surface of the glass substrate 1.

If the aluminum film according to the third embodiment is provided for the fluorescent surface of the FED according to the second embodiment, a problem that the fluorescent material in the fluorescent surface is decomposed due to the collision of the electrons can be prevented even if the voltage for operating the FED is raised. Since higher operating voltage can be applied, the luminance of emitted light in the FED can be raised.

Since the surfaces of particles of the fluorescent material are not denatured due to the ionic characteristic of the slurry solution, the luminous efficiency of the fluorescent material cannot deteriorate. Therefore, the obtained fluorescent film is able to emit bright light. In particular, green light emission can be realized from the $ZnGa_2O_4$:Mn fluorescent material which has poor tolerance to acid. As a result, a reliable and full color FED can be manufactured by using the oxide type fluorescent material which does not contaminate the emitter of the field-emission-type cathode.

Moreover, the fluorescent film using the red, green and blue fluorescent materials is manufactured such that the $ZnGa_2O_4$:Mn fluorescent material, the patterning characteristic is unsatisfactory, is employed as one of the fluorescent materials and the styryl pyridium photosensitive resin of a type such that the photosensitive group of the SbQ has an internal salt structure is employed as the photosensitive material for the slurry solution for each fluorescent material. However, this embodiment is arranged to perform patterning such that the overcoat material which includes organic solvent type photosensitive resin including hydroxypropylcellulose and the photooxididation generating material and which can be developed with water is used to cover the $ZnGa_2O_4$:Mn fluorescent material layer (the green fluorescent-material layer 5). Therefore, the coated pattern composed of the red, green and blue fluorescent materials can be formed without any unintentional color mixture.

The glass substrate 1 having the pattern composed of the red, green and blue fluorescent material layers is employed as the anode substrate, and the field-emission-type cathode formed on the inner surface of the cathode substrate is placed to face the anode substrate, followed by sealing the outer gap between the two substrates to form an envelope including a high vacuum space. Thus, a full color graphic display FED can be manufactured. Since the $ZnGa_2O_4$:Mn on the fluorescent surface according to the present does not deteriorate the luminous efficiency, it can be used as the fluorescent material capable of emitting green light which can be employed in place of the sulfide type fluorescent material which contaminates the emitter because of scattering of the sulfide The thus-manufactured FED is able to display a full color graphic image with satisfactorily high brightness.

Moreover, the fluorescent film using the red, green and blue fluorescent materials is manufactured such that the $ZnGa_2O_4$:Mn fluorescent material, the patterning characteristic of which is unsatisfactory, is employed as one of the fluorescent materials and the styryl pyridium photosensitive resin of a type such that the photosensitive group of the SbQ has an internal salt structure is employed as the photosensitive material for the slurry solution for each fluorescent material. However, this embodiment is structured such that patterning is performed such that the overcoat material which includes organic solvent type photosensitive resin including hydroxypropylcellulose and the photooxididation generating material and which can be developed with water is used to cover the $ZnGa_2O_4$:Mn fluorescent material layer (the green fluorescent-material layer 5). Therefore, the coated pattern composed of the red, green and blue fluorescent materials can be formed without any unintentional color mixture.

The glass substrate 1 having the pattern composed of the red, green and blue fluorescent material layers is employed as the anode substrate, and the field-emission-type cathode formed on the inner surface of the cathode substrate is placed to face the anode substrate, followed by sealing the outer gap between the two substrates to form an envelope including a high vacuum space. Thus, full color graphic display FED can be manufactured. Since the $ZnGa_2O_4$:Mn on the fluorescent surface according to the present does not deteriorate the luminous efficiency, it can be used as the fluorescent material capable of emitting green light which can be employed in place of the sulfide type fluorescent material which contaminates the emitter because of scattering of the sulfide. The thus-manufactured FED is able to display a full color graphic image with satisfactorily high brightness.

Moreover, when the fluorescent surface composed of plural types of fluorescent materials is formed on the glass substrate 1, the solution for forming the fluorescent surface containing the photosensitive resin is applied to the surface of the glass substrate 1, and then the overcoat material containing the photosensitive resin is applied the solution on the glass substrate 1. Then, the exposure process is performed on the applied overcoat material so that patterning is performed in a state where the fluorescent material layer is covered with the overcoat layer 7. Therefore, if the following process is performed such that the fluorescent material layer is formed by using another material for forming the fluorescent surface, the fluorescent material layer covered with the overcoat layer 7 is free from color mixture with the fluorescent material for use in the following process.

As a result, a SbQ group having an internal salt structure having an unsatisfactory patterning characteristic is employed in order to prevent the ionic influence of the SbQ group or if the fluorescent material, such as the $ZnGa_2O_4$:Mn fluorescent material, having unsatisfactory patterning characteristic is employed, a fluorescent surface composed of plural types of fluorescent materials can be formed into a predetermined pattern without any color mixture.

Although the invention has been described in its preferred form with a certain degree of particularity, it is understood that the present disclosure of the preferred form can be changed in the details of construction and in the combination and arrangement of parts without departing from the spirit and the scope of the invention as hereinafter claimed.

What is claimed is:

1. A method of forming a fluorescent film for a display, comprising the steps of:

coating a surface with a composition for forming a fluorescent film for a display, having a $ZnGa_2O_4$:Mn fluorescent material which easily reacts with photosensitive resin having a styryl pyridium photosensitive group having an internal salt structure, so as to form a fluorescent material layer;

selectively performing exposure by irradiating the upper surface of the fluorescent material layer with ultraviolet rays and developing the fluorescent material layer to form the fluorescent material layer into a predetermined pattern; and baking the fluorescent material layer formed into a predetermined pattern.

2. A method of forming a fluorescent film for a display, comprising the steps of:

forming an anode conductor on a predetermined surface;

coating the surface of the anode conductor with a composition for forming a fluorescent film for a display, having photosensitive resin having a styryl pyridium photosensitive group having an internal salt structure and a $ZnGa_2O_4$:Mn fluorescent material which easily reacts with acid, to form a fluorescent material layer;

selectively performing exposure by irradiating the upper surface of the fluorescent material layer with ultraviolet rays and developing the fluorescent material layer to form the fluorescent material layer into a predetermined pattern; and baking the fluorescent material layer formed into a predetermined pattern.

3. A method of forming a fluorescent film for a display, comprising the steps of:

forming an anode conductor on a predetermined surface;

forming a precoat film on the anode conductor;

coating the surface of the precoat film with a composition for forming a fluorescent film for a display, having photosensitive resin having a styryl pyridium photosensitive group having an internal salt structure and a $ZnGa_2O_4$:Mn fluorescent material which easily reacts with acid, to form a fluorescent material layer;

selectively performing exposure by irradiating the upper surface of the fluorescent material layer with ultraviolet rays and developing the fluorescent material layer to form the fluorescent material layer into a predetermined pattern; and baking the fluorescent material layer formed into a predetermined pattern.

4. A method of forming a fluorescent film for a display according to any one of claims 1 to 3, wherein the baking process is performed in an oxidation atmosphere at 400 to 500° C.

5. A method of forming a fluorescent film for a display according to claim 2 or 3, wherein the predetermined surface is a glass substrate, and the anode conductor is a translucent and conductive film.

6. A method of forming a fluorescent film for a display according to claim 5, wherein the translucent and conductive film is made of indium tin oxide.

7. A method of forming a fluorescent film for a display according to claim 5, wherein the translucent and conductive film is made of a thin metal film having a gap.

8. A method of forming a fluorescent film such that a fluorescent film made of plural types of fluorescent materials is formed on an insulating surface, said method of forming a fluorescent film comprising the steps of:

applying an aqueous material for forming a fluorescent film containing first photosensitive resin having a styryl pyridium photosensitive group having an internal salt structure and a fluorescent material to the surface of an insulating surface to form a fluorescent material layer;

applying an overcoat material containing second photosensitive resin to the surface of the fluorescent material layer to form an overcoat layer from an organic based coating solution; and selectively performing exposure by irradiating the overcoat and fluorescent materials layers with ultraviolet rays and then developing the overcoat and fluorescent materials layer so as to form the fluorescent material layer and the overcoat and fluorescent material layers into predetermined patterns, wherein at least one fluorescent material of the plural types of the fluorescent materials is subjected to the above-mentioned steps.

9. A method of forming a fluorescent film such that a fluorescent film made of plural types of fluorescent materials is formed on an insulating glass substrate, said method of forming a fluorescent film comprising the steps of:

forming an anode conductor on the glass substrate;

applying an aqueous material for forming a fluorescent film containing first photosensitive resin having a styryl pyridium photosensitive group having an internal salt structure and a fluorescent material to the surface of the anode conductor to form a fluorescent material layer;

applying an overcoat material containing second photosensitive resin to the surface of the fluorescent material layer to form an overcoat layer from an organic based coating solution; and selectively performing exposure by irradiating the overcoat and fluorescent material layers with ultraviolet rays and then developing the overcoat and fluorescent material layers so as to form the fluorescent material layer and the overcoat and fluorescent material layers into predetermined patterns, wherein at least one fluorescent material of the plural types of the fluorescent materials is subjected to the above-mentioned steps.

10. A method of forming a fluorescent film according to claim 9, wherein the anode conductor is a translucent and conductive film.

11. A method of forming a fluorescent film accordccording to claim 10, wherein the translucent and conductive film is made of indium tin oxide.

12. A method of forming a fluorescent film according to claim 10, wherein the translucent and conductive film is made of a thin metal film having a gap.

13. A method of forming a fluorescent film such that a fluorescent film made of plural types of fluorescent materials is formed on an insulating glass substrate, said method of forming a fluorescent film comprising the steps of:

applying an aqueous material for forming a fluorescent film containing first photosensitive resin having a styryl pyridium photosensitive group having an internal salt structure and a fluorescent material to the surface of a glass plate to form a fluorescent material layer;

applying an overcoat material containing second photosensitive resin to the surface of the fluorescent material layer to form an overcoat layer from an organic based coating solution; and selectively performing exposure by irradiating the overcoat and fluorescent material layers with ultraviolet rays and then developing the overcoat and fluorescent material layer so as to form the fluorescent material layers and the overcoat and fluorescent material layers into predetermined patterns, wherein p1 at least one fluorescent material of the plural types of the fluorescent materials is subjected to the above-mentioned steps so that a fluorescent surface is formed, and then a thin metal film is formed on the fluorescent film.

14. A method of forming a fluorescent film according to any one of claims 8, 9 and 13, wherein the second photosensitive resin contained in the overcoat material is photosensitive resin of an organic solvent coating type which can be developed with water.

15. A method of forming a fluorescent film according to claim 4, wherein the second photosensitive resin contained in the overcoat material contains hydroxypropylcellulose and photooxidation generating material.

16. A composition for forming a fluorescent film for display comprising an aqueous medium, comprising:

photosensitive resin having a styryl pyridium photosensitive group having an internal salt structure, and a $ZnGa_2O_4$:Mn fluorescent material.

* * * * *